US011072055B2

(12) United States Patent
Huang

(10) Patent No.: US 11,072,055 B2
(45) Date of Patent: Jul. 27, 2021

(54) SCREWING TOOL

(71) Applicant: Yen-Chia Huang, Taichung (TW)

(72) Inventor: Yen-Chia Huang, Taichung (TW)

( * ) Notice: Subject to any disclaimer, the term of this patent is extended or adjusted under 35 U.S.C. 154(b) by 387 days.

(21) Appl. No.: 16/188,381

(22) Filed: Nov. 13, 2018

(65) Prior Publication Data

US 2020/0047318 A1 Feb. 13, 2020

(30) Foreign Application Priority Data

Aug. 13, 2018 (TW) ..... 107211053

(51) Int. Cl.

| | |
|---|---|
| ***B25B 23/16*** | (2006.01) |
| ***B25B 23/00*** | (2006.01) |
| ***B25G 1/08*** | (2006.01) |
| ***B25B 15/02*** | (2006.01) |

(52) U.S. Cl.

CPC ..... *B25B 23/0035* (2013.01); *B25B 15/02* (2013.01); *B25G 1/085* (2013.01)

(58) Field of Classification Search

CPC ..... Y10T 279/17666

See application file for complete search history.

(56) References Cited

U.S. PATENT DOCUMENTS 6,901,826 B2 * 6/2005 Huang ..... B25B 15/02 81/177.2

6,978,504 B1 * 12/2005 Smith ..... B25B 15/02 7/165

2014/0360319 A1 12/2014 Huang

* cited by examiner

*Primary Examiner* — Orlando E Aviles
*Assistant Examiner* — Donna Maynard
(74) *Attorney, Agent, or Firm* — Burris Law, PLLC

(57) ABSTRACT

A screwing tool includes a handle, a tubular member fitted inside the handle, an inner sleeve mounted slidably inside the tubular member, an elongated bit mounted slidably inside the inner sleeve, at least one retaining member disposed in a passage of the inner sleeve, an actuating member coupled to permit the inner sleeve to slide therewith, and a biasing member disposed to bias the inner sleeve to a first position. When the inner sleeve is in the first position, the elongated bit is retained by the retaining member. When the inner sleeve is moved to a second position against a biasing force of the biasing member, the elongated bit may slide relative to the handle.

7 Claims, 5 Drawing Sheets

SCREWING TOOL

CROSS-REFERENCE TO RELATED APPLICATION

This application claims priority from Taiwanese utility model patent application no. 107211053, filed on Aug. 13, 2018.

FIELD

The disclosure relates to a screwing tool having a handle and an elongated bit which can be slidably positioned relative to the handle.

BACKGROUND

U.S. patent application publication no. 2014/360319 A1 discloses a hand tool which includes a tubular casing, a tubular member connected to the tubular casing, a rod body extending through the tubular member into the tubular casing, two collar assemblies surrounded respectively by two oppositely-extending frustoconical urging surface portions of the tubular member and surrounding the rod body, and two resilient members biasing respectively the collar assemblies to abut against the rod body and abut respectively against the urging surface portions to thereby restrain the rod body from moving relative to the tubular casing. When the collar assemblies are moved to be released from the rod body and the urging surface portions, the rod body is permitted to move relative to the tubular casing.

SUMMARY

An object of the disclosure is to provide a novel screwing tool with a simplified configuration, in which an elongated bit can be slidably positioned relative to a handle.

According to the disclosure, a screwing tool includes a handle, a tubular member, an inner sleeve, an elongated bit, at least one retaining member, an actuating member, and a biasing member. The handle defines therein an elongated cavity along a longitudinal axis. The tubular member is configured to be immovably fitted in the elongated cavity, and has an inner peripheral surface which defines therein a bore extending along the longitudinal axis, and which has a guiding surface region. The inner sleeve is slidably mounted on the guiding surface region along the longitudinal axis and is displaceable between a first position and a second position. The inner sleeve has an inner end segment disposed inside the bore, and an outer end segment disposed outwardly of the bore. The inner sleeve has a through hole along the longitudinal axis and at least one passage extending radially therethrough and proximate to the outer end segment. The elongated bit is configured to be slidably and non rotatably received in the through hole, and includes two opposite ends opposite to each other along the longitudinal axis, and an elongated body between the two opposite ends. The retaining member has an abutted end and a retaining end radially opposite to the abutted end, and is disposed in the passage to be movable radially between an inward position, where the inner sleeve is in the first position and the retaining end is in pressing engagement with the elongated body, to prevent sliding movement of the elongated bit, and an outward position, where the inner sleeve is in the second position and the retaining end is retractable in the passage to permit the sliding movement of the elongated bit. The actuating member is coupled to the outer end segment of the inner sleeve to permit the inner sleeve to slide with the actuating member along the longitudinal axis between a locked position corresponding to the first position, and an unlocked position corresponding to the second position. The biasing member is disposed on the inner sleeve to bias the inner sleeve to the first position. The inner peripheral surface of the tubular member further has a confronting surface region, which is displaced from the guiding surface region to confront the retaining member, and which includes a first zone and a second zone. The first zone is configured to be in pressing engagement with the abutted end when the inner sleeve is in the first position. The second zone is configured to confront the abutted end when the inner sleeve is in the second position, and has a larger dimension than the first zone to permit the retaining end to be retracted in the passage in response to the sliding movement of the elongated bit.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
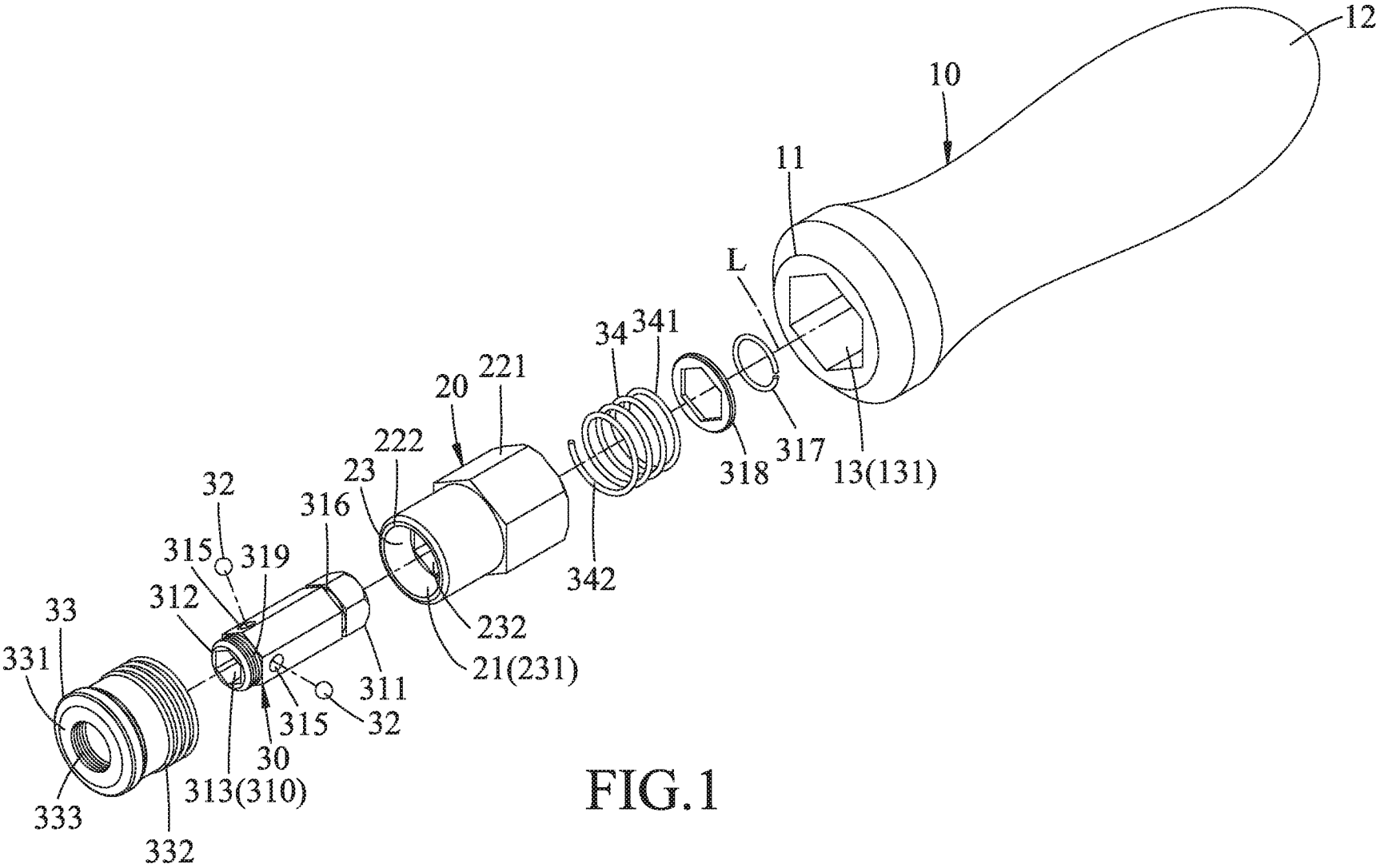
FIG. 1 is an exploded perspective view of a screwing tool according to a first embodiment of the disclosure, omitting an elongated bit.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 2:
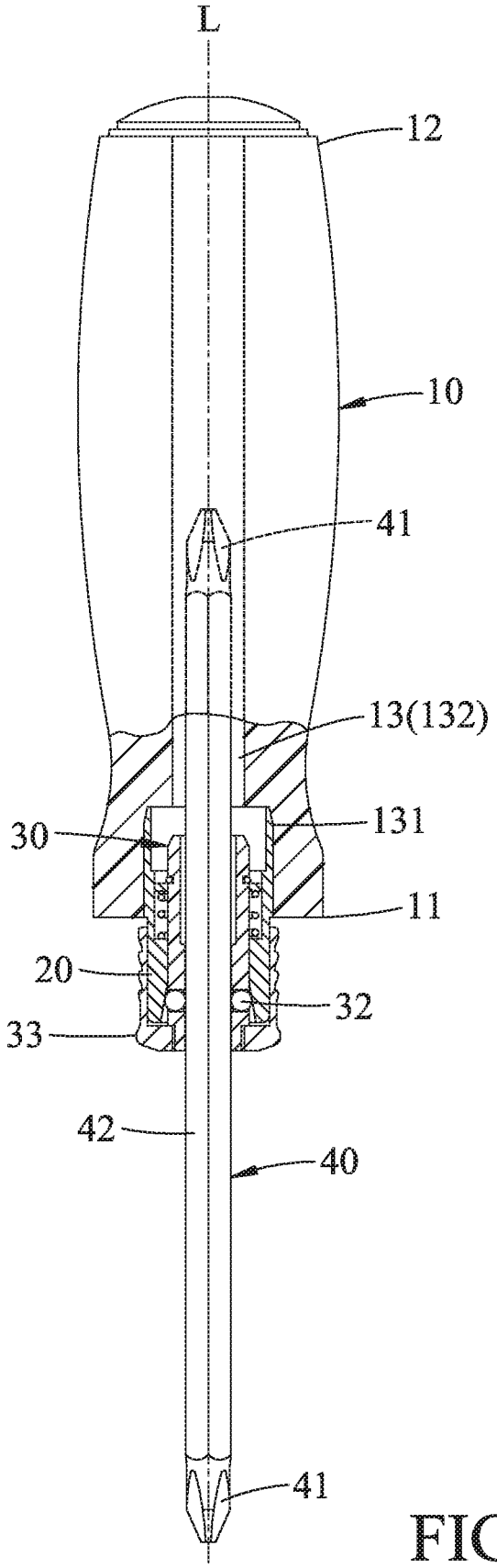
FIG. 2 is a partial cross-sectional view of the screwing tool.
Figure 3:
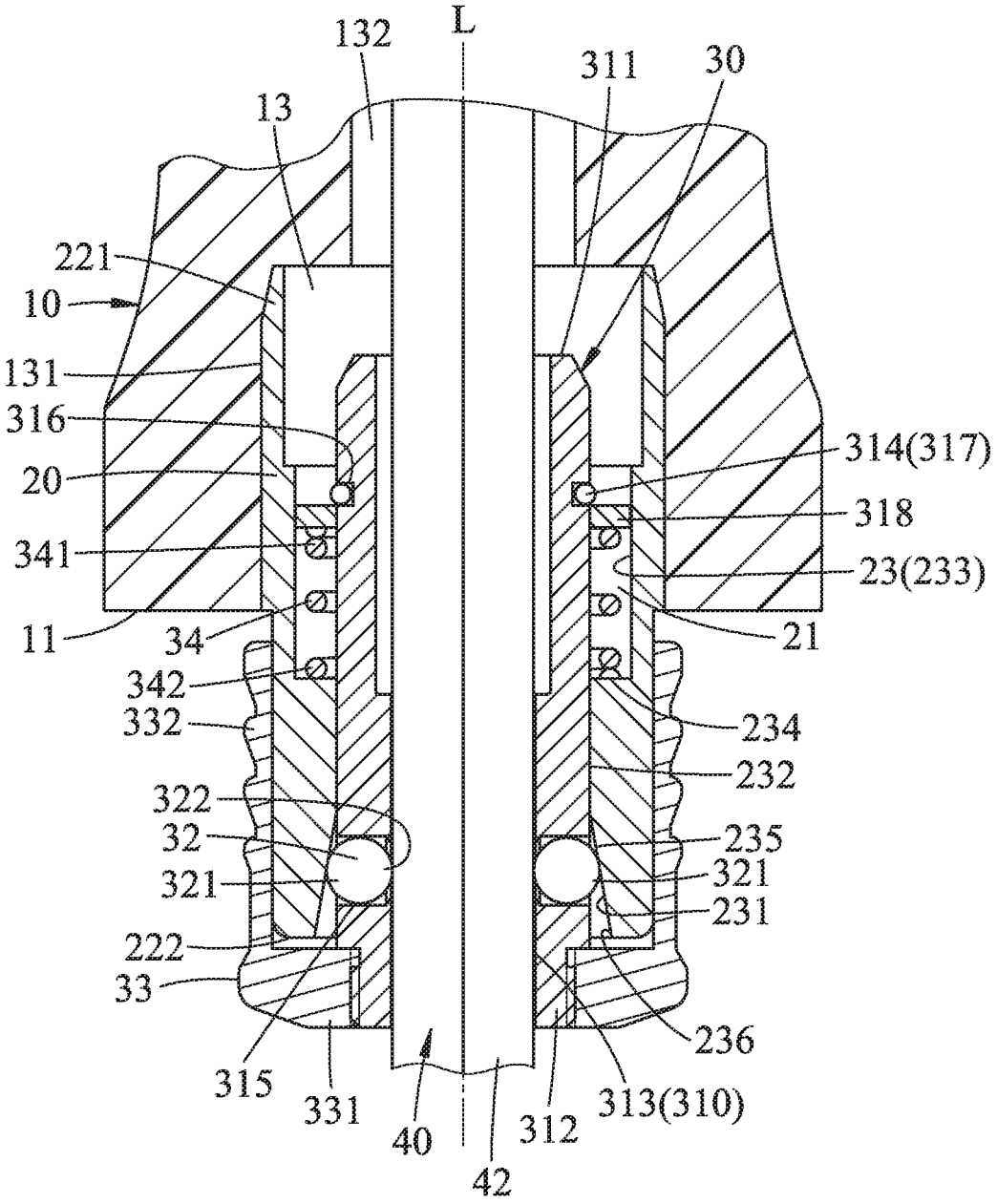
FIG. 3 is a fragmentary partial enlarged view of FIG. 3 illustrating a locked position.

Referring to FIGS. 1 to 3, a screwing tool according to a first embodiment of the disclosure is shown to include a handle 10, a tubular member 20, an inner sleeve 30, an elongated bit 40, at least one retaining member 32, an actuating member 33, and a biasing member 34.

The handle 10 extends along a longitudinal axis (L) to terminate at a rear end 12 and a front end 11 opposite to the rear end 12 along the longitudinal axis (L). The handle 10 defines therein an elongated cavity 13 extending from the front end 11 along the longitudinal axis (L) toward the rear end 12.

In an embodiment shown in FIG. 2, the elongated cavity 13 has a smaller dimension segment 132 and a larger dimension segment 131 which are proximate to and distal from the rear end 12, respectively.

The tubular member 20 is configured to be immovably fitted in the elongated cavity 13, and has an inner peripheral surface 23 which defines therein a bore 21 extending along the longitudinal axis (L), and which has a guiding surface region 232.

In an embodiment shown in FIGS. 1 to 3, the tubular member 20 includes a rearward segment 221 configured to be immovably fitted in the larger dimension segment 131, and a forward segment 222 which is opposite to the rearward segment 221 along the longitudinal axis (L), and which is disposed forwardly of the front end 11 of the handle 10.

In an embodiment shown in FIGS. 1 to 3, each of the rearward segment 221 and the larger dimension segment 131 has a polygonal (hexagonal) cross-section.

Furthermore, the inner peripheral surface 23 of the tubular member 20 further has a confronting surface region 231 which is displaced from the guiding surface region 232 to confront the retaining member 32, and which includes a first zone 235 and second zone 236. In an embodiment shown in FIGS. 3 and 4, the guiding surface region 232 and the confronting surface region 231 are disposed proximate to and distal from the rear end 12, respectively.

Figure 4:
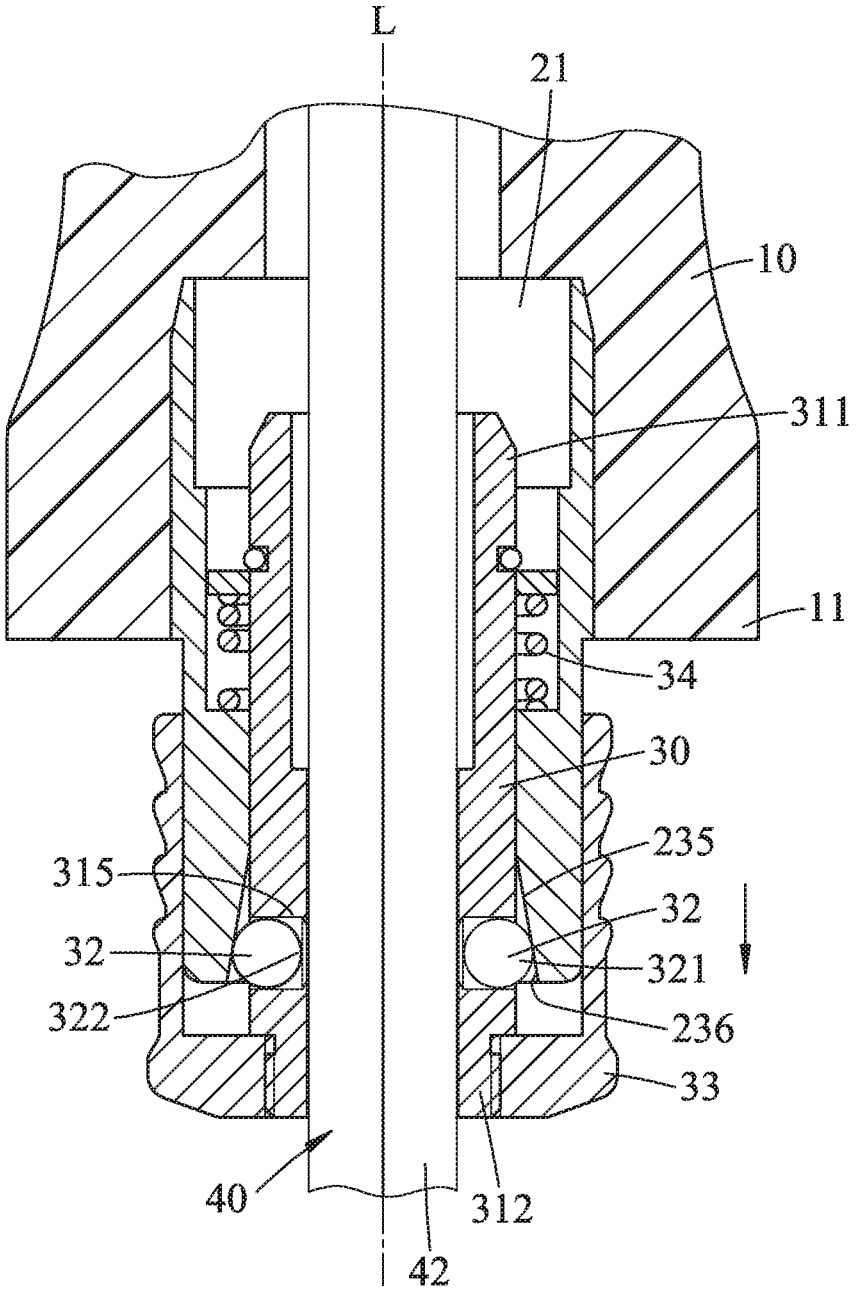
FIG. 4 is similar to FIG. 3 but illustrating an unlocked position.

In an embodiment shown in FIGS. 3 and 4, the confronting surface region 231 diverges from the first zone 235 to the second zone 236.

In an embodiment shown in FIGS. 3 and 4, the inner peripheral surface 23 of the tubular member 20 further has a rear surface region 233. The guiding surface region 232 is disposed between the rear surface region 233 and the confronting surface region 231, and has a smaller dimension than the rear surface region 233, forming a shoulder surface 234.

The inner sleeve 30 is non-rotatably mounted in the bore 21, and is slidably mounted on the guiding surface region 232 along the longitudinal axis (L) to be displaceable between a first position (see FIGS. 2 and 3) proximate to the rear end 12, and a second position distal from the rear end 12 (see FIGS. 2 and 4). In the first position, as shown in FIG. 3, the first zone 235 confronts the retaining member 32. In the second position, as shown in FIG. 4, the second zone 236 confronts the retaining member 32. The inner sleeve 30 has an inner end segment 311 disposed inside the bore 21, and an outer end segment 312 disposed outwardly of the bore 21. The inner sleeve 30 has a through hole 313 along the longitudinal axis (L) and at least one passage 315 extending radially therethrough and proximate to the outer end segment 312.

The elongated bit 40 is configured to be slidably and non-rotatably received in the through hole 313, and includes two opposite ends 41 opposite to each other along the longitudinal axis (L), and an elongated body 42 between the two opposite ends 41. At least one of the ends 41 is a drive tip. In an embodiment shown in FIG. 2, each of the ends 41 is a drive tip.

In an embodiment shown in FIGS. 1 to 3, the through hole 313 is, at least in part, shaped as a polygonal (hexagonal) hole 310, and the elongated body 40 has a polygonal (hexagonal) cross-section to permit the elongated body 40 to be non-rotatably and slidably fitted in the polygonal hole 310.

The retaining member 32 has an abutted end 321 and a retaining end 322 radially opposite to the abutted end 321, and is disposed in the passage 315 to be movable radially between an inward position and an outward position. In the inward position, as shown in FIG. 3, the inner sleeve 30 is in the first position, and the retaining end 322 is in pressing engagement with the elongated body 42 to prevent sliding movement of the elongated bit 40. In the outward position, as shown in FIG. 4, the inner sleeve 30 is in the second position, and the retaining end 322 is retractable in the passage 315 to permit the sliding movement of the elongated bit 40.

In addition, when the inner sleeve 30 is in the first position (FIG. 3), the first zone 235 is in pressing engagement with the abutted end 321. When the inner sleeve 30 is in the second position (FIG. 4), the second zone 236 confronts the abutted end 321. The second zone 236 has a larger dimension than the first zone 235 so as to permit the retaining end 322 to be retracted in the passage 315 in response to the sliding movement of the elongated bit 40.

In an embodiment, the retaining members 32 may be a steel rolling ball, and the passage 315 may have an inner region which has a diameter slightly smaller than that of the steel rolling ball 32 to prevent the steel rolling ball 32 from falling into the through hole 313, and an outer region which has a diameter slightly larger than that of the steel rolling ball 32.

In an embodiment shown in FIGS. 1 to 3, the inner sleeve 30 has a plurality of the passages 315, and a plurality of the retaining members 32 are respectively received in the passages 315.

The actuating member 33 is coupled to the outer end segment 312 of the inner sleeve 30 to permit the inner sleeve 30 to slide with the actuating member 33 along the longitudinal axis (L) between a locked position corresponding to the first position (FIG. 3), and an unlocked position corresponding to the second position (FIG. 4).

In an embodiment shown in FIGS. 1 to 3, the actuating member 33 includes a front wall 331 and a surrounding wall 332. The front wall 331 has a female threaded opening 333 along the longitudinal axis (L). The surrounding wall 332 extends rearwardly from a periphery of the front wall 331 along the longitudinal axis (L).

In addition, the outer end segment 312 of the inner sleeve 30 has a male threaded region 319 configured to be threadedly engaged within the female threaded opening 333 so as to permit the inner sleeve 30 to slide with the actuating member 33 along the longitudinal axis (L), and to permit the surrounding wall 332 to be slidably sleeved on the forward segment 222 of the tubular member 20.

The biasing member 34 disposed on the inner sleeve 30 to bias the inner sleeve 30 to the first position.

In operation, to have any exposed working length of the elongated bit 40 desired by the user, it is only necessary to grip the surrounding wall 332 and pull the actuating member 33 forwardly to permit the elongated bit 40 to slide relative to the handle 10.

In an embodiment shown in FIGS. 1 to 3, the biasing member 34 is a compressible coil spring sleeved on the inner sleeve 30, and having a first spring end segment 341 and a second spring end segment 342. The first spring end segment 341 is disposed to abut on an outer peripheral surface of the inner sleeve 30, while the second spring end segment 342 is in abutting engagement with the shoulder surface 234 so as to bias the inner sleeve 30 to the first position.

In an embodiment shown in FIGS. 1 to 3, the outer peripheral surface of the inner sleeve 30 is formed with a retaining groove 316 which surrounds the longitudinal axis (L) in proximity to the inner end segment 311. The screwing tool further includes a hoop member 317 and a collar member 318. The hoop member 317 is configured to be fitted in the retaining groove 316 to form, on the inner sleeve 30, an outer flange 314 for confronting the first spring end segment 341. The collar member 318 is configured to be sleeved on the inner sleeve 30 and is disposed between the outer flange 314 and the first spring end segment 341 to permit the first spring end segment 341 to abut against the collar member 318.

Figure 5:
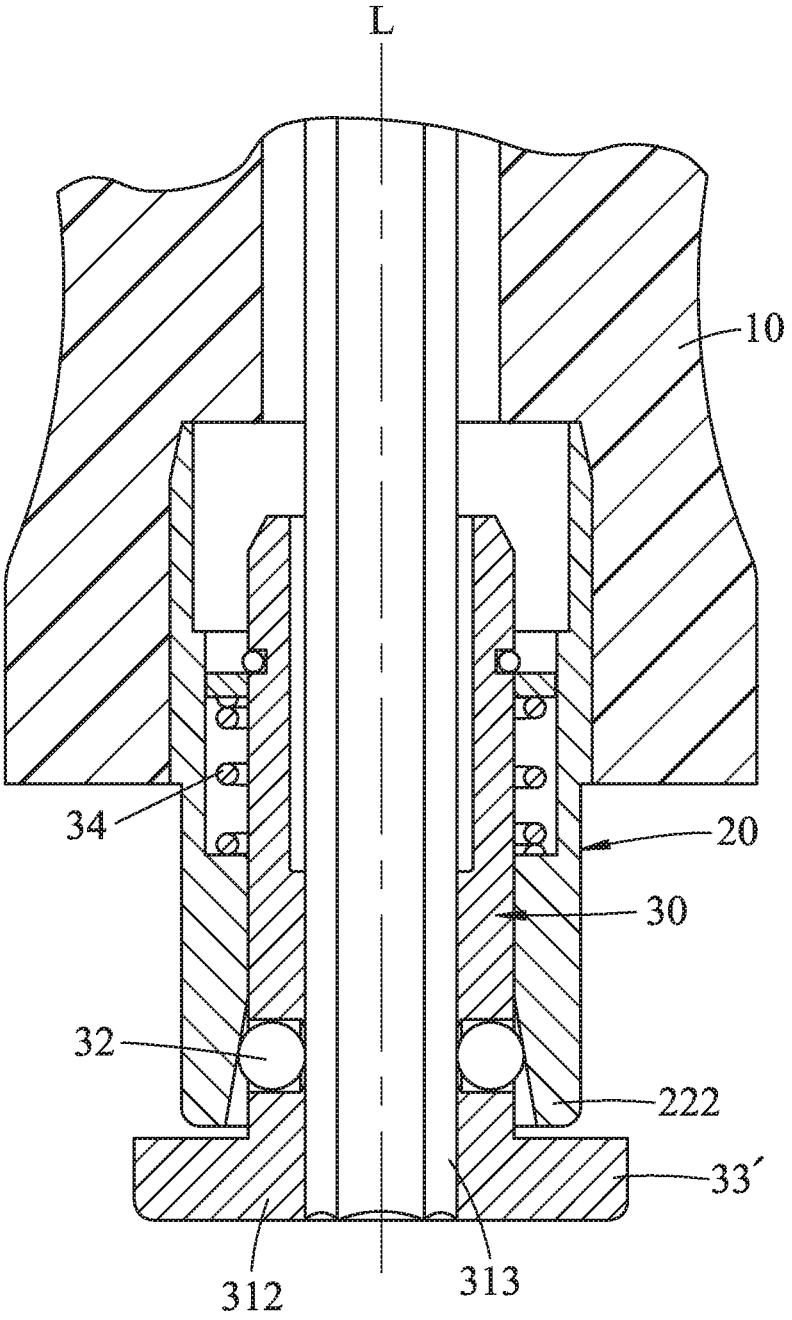
FIG. 5 is a fragmentary cross-sectional view of screwing tool according to a second embodiment of the disclosure, omitting an elongated bit.

FIG. 5 illustrates a screwing tool according to a second embodiment of the disclosure. The second embodiment is similar to the first embodiment except that in the second embedment, an actuating member 33' is in the form of a ring and is formed integrally with the inner sleeve 30.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiments), it is understood that this disclosure is not limited to the disclosed embodiments) but is intended to cover various arrangements included within the spirit and scope of the broadest interpretation so as to encompass all such modifications and equivalent arrangements.

What is claimed is:

1. A screwing tool comprising:

a handle defining therein an elongated cavity along a longitudinal axis;

a tubular member configured to be immovably fitted in said elongated cavity, and said tubular member having an inner peripheral surface which defines therein a bore extending along the longitudinal axis, and which has a guiding surface region;

an inner sleeve which is slidably mounted on said guiding surface region along the longitudinal axis and displaceable between a first position and a second position, said inner sleeve having an inner end segment disposed inside said bore, and an outer end segment disposed outwardly of said bore, said inner sleeve having a through hole along the longitudinal axis and at least one passage extending radially therethrough and proximate to said outer end segment;

an elongated bit which is configured to be slidably and non-rotatably received in said through hole, and which includes two opposite ends opposite to each other along the longitudinal axis, and an elongated body between said two opposite ends;

at least one retaining member which has an abutted end and a retaining end radially opposite to said abutted end, and which is disposed in said passage to be movable radially between an inward position, where said inner sleeve is in the first position and said retaining end is in pressing engagement with said elongated body, to prevent sliding movement of said elongated bit, and an outward position, where said inner sleeve is in the second position and said retaining end is retractable in said passage to permit the sliding movement of said elongated bit;

an actuating member which is coupled to said outer end segment of said inner sleeve to permit said inner sleeve to slide with said actuating member along the longitudinal axis between a locked position corresponding to the first position, and an unlocked position corresponding to the second position; and a biasing member disposed on said inner sleeve to bias said inner sleeve to the first position, wherein said inner peripheral surface of said tubular member further has a confronting surface region, which is displaced from said guiding surface region to confront said retaining member, and which includes a first zone configured to be in pressing engagement with said abutted end when said inner sleeve is in the first position, and a second zone which is configured to confront said abutted end when said inner sleeve is in the second position, and which has a larger dimension than said first zone to permit said retaining end to be retracted in said passage in response to the sliding movement of said elongated bit, wherein said handle extends along the longitudinal axis to terminate at a rear end and a front end, and said elongated cavity extends from said front end along the longitudinal axis toward said rear end, said elongated cavity having a smaller dimension segment and a larger dimension segment which are proximate to and distal from said rear end, respectively;

wherein said tubular member includes a rearward segment configured to be immovably fitted in said larger dimension segment, and a forward segment which is opposite to said rearward segment along the longitudinal axis, and which is disposed forwardly of said front end of said handle;

wherein said actuating member includes a front wall having a female threaded opening along the longitudinal axis, and a surrounding wall extending rearwardly from a periphery of said front wall along the longitudinal axis; and wherein said outer end segment of said inner sleeve has a male threaded region configured to be threadedly engaged within said female threaded opening so as to permit said inner sleeve to slide with said actuating member along the longitudinal axis, and to permit said surrounding wall to be slidably sleeved on said forward segment of said tubular member.

2. The screwing tool according to claim 1, wherein said inner sleeve which is non-rotatably mounted in said bore.

3. The screwing tool according to claim 1, wherein said guiding surface region and said confronting surface region are disposed proximate to and distal from said rear end, respectively, said confronting surface region diverging from said first zone to said second zone.

4. The screwing tool according to claim 3, wherein said inner peripheral surface of said tubular member further has a rear surface region, said guiding surface region being disposed between said rear surface region and said confronting surface region, and having a smaller dimension than said rear surface region to form a shoulder surface;

said biasing member is a coil spring sleeved on said inner sleeve, and having a first spring end segment which is disposed to abut on an outer peripheral surface of said inner sleeve, and a second spring end segment which is in abutting engagement with said shoulder surface so as to bias said inner sleeve to the first position.

5. The screwing tool according to claim 4, wherein said outer peripheral surface of said inner sleeve is formed with a retaining groove which surrounds the longitudinal axis in proximity to said inner end segment, said screwing tool further comprising a hoop member configured to be fitted in said retaining groove to form, on said inner sleeve, an outer flange for confronting said first spring end segment, and a collar member configured to be sleeved on said inner sleeve and disposed between said outer flange and said first spring end segment to permit said first spring end segment to abut against said collar member.

6. The screwing tool according to claim 1, wherein said actuating member is in the form of a ring and is formed integrally with said inner sleeve.

7. The screwing tool according to claim 1, wherein said through hole is, at least in part, shaped as a polygonal hole, and said elongated body has a polygonal cross-section to permit said elongated body to be non-rotatably and slidably fitted in said polygonal hole.

* * * * *